US007405517B2

(12) United States Patent
Park

(10) Patent No.: US 7,405,517 B2
(45) Date of Patent: Jul. 29, 2008

(54) PLASMA DISPLAY PANEL

(75) Inventor: Jung-Tae Park, Suwon-si (KR)

(73) Assignee: Samsung SDI Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/640,549

(22) Filed: Dec. 18, 2006

(65) Prior Publication Data

US 2007/0152582 A1 Jul. 5, 2007

(30) Foreign Application Priority Data

Dec. 30, 2005 (KR) ..... 10-2005-0135863

(51) Int. Cl.
*H01J 17/49* (2006.01)

(52) U.S. Cl. ..... 313/582; 313/587

(58) Field of Classification Search ..... 313/582, 313/583–587; 315/169.1, 169.4; 345/37, 345/41, 60

See application file for complete search history.

(56) References Cited

U.S. PATENT DOCUMENTS 6,097,149 A * 8/2000 Miyaji et al. ..... 313/582
6,517,400 B1 * 2/2003 Cho et al. ..... 445/24
2002/0024303 A1 * 2/2002 Sano et al. ..... 313/582
2002/0167275 A1 * 11/2002 Bechtel et al. ..... 313/587
2005/0104518 A1 * 5/2005 Hong et al. ..... 313/582
2007/0152590 A1 * 7/2007 Park ..... 313/586

* cited by examiner

*Primary Examiner*—Joseph L. Williams
*Assistant Examiner*—Hana A Sanei
(74) *Attorney, Agent, or Firm*—Knobbe Martens Olson & Bear LLP

(57) ABSTRACT

Provided is a plasma display panel (PDP) that displays images by generating discharges in discharge cells in response to a power supplied through a metal electrode disposed toward a surface of the plasma display panel on which images are displayed. The PDP includes a first substrate and a second substrate facing each other; a plurality of barrier ribs that define a space into a plurality of discharge cells between the first and second substrates; a plurality of sustain electrode pairs that extend in a direction between the first and second substrates, and consist of transparent electrodes having light transmittance and bus electrodes formed of a metal, wherein the bus electrodes are made of a dark component that absorbs light and a bright component that reflects light; a plurality of address electrodes crossing the sustain electrode pairs; a first dielectric layer covering the sustain electrode pairs; a second dielectric layer covering the address electrodes; phosphor layers formed in the discharge cells; and first reflectors disposed on surfaces of the bus electrodes facing the center of the discharge cells to prevent light generated in the discharge cells from being absorbed by the bus electrodes and to reflect the light.

9 Claims, 6 Drawing Sheets

PLASMA DISPLAY PANEL

CROSS-REFERENCE TO RELATED PATENT APPLICATION

This application claims the benefit of Korean Patent Application No. 10-2005-0135863, filed on Dec. 30, 2005, in the Korean Intellectual Property Office, the disclosure of which is incorporated herein in its entirety by reference.

BACKGROUND OF THE INVENTION

1. Field of the Invention

The present embodiments relate to a plasma display panel, and more particularly, to a plasma display panel that displays images by generating discharges in discharge cells in response to a power supplied through a metal electrode disposed toward a surface of the plasma display panel on which images are displayed.

2. Description of the Related Art

In recent times, plasma display panels, which are expected to replace conventional cathode ray tube display devices, have received much attention. Plasma display panels display images using visible light emitted through a process in which a phosphor material formed in a predetermined pattern in a space is excited with ultraviolet rays generated by a discharge of a discharge gas in the space when a discharge voltage is applied to the electrodes.

FIG. 1 is an exploded perspective view of a conventional plasma display panel (PDP).

Referring to FIG. 1, a typical alternating current type PDP 10 includes an upper plate 50 on which images are displayed and a lower plate 60 coupled to the upper plate and parallel to the upper plate 50. Sustain electrode pairs 12 in which an X electrode 31 and a Y electrode 32 form a pair are formed on a front substrate 11 of the upper plate 50. Address electrodes 22 crossing the X and Y electrodes 31 and 32 of the front substrate 11 are disposed on a rear substrate 21 of the lower plate 60 that faces a surface of the front substrate 11 where the sustain electrode pairs 12 are disposed.

A first dielectric layer 15 in which the sustain electrode pairs 12 are buried and a second dielectric layer 25 in which the address electrodes 22 are buried are respectively formed on the front substrate 11 and the rear substrate 21. A protective layer 16 is usually formed of MgO on a rear surface of the first dielectric layer 15, and barrier ribs 30 that maintain a discharge distance between the front substrate 11 and the rear substrate 21 and prevent electrical and optical cross-talk between discharge cells are formed on an front surface of the second dielectric layer 25.

Red, green, and blue phosphor layers 26 are coated on both side surfaces of the barrier ribs 30 and on an entire surface of the second dielectric layer 25 where the barrier ribs 30 are not formed.

The X electrode 31 and the Y electrode 32 include transparent electrodes 31*a* and 32*a*, respectively, and bus electrodes 31*b* and 32*b*, respectively. A space formed by the pair of the X electrode 31 and the Y electrode 32 and the address electrodes 22 crossing the X and Y electrodes 31 and 32 is a unit discharge cell 70 which forms one discharge unit.

The transparent electrodes 31*a* and 32*a* are formed of a conductive transparent material that can generate discharges and does not interrupt the progress of light emitted from phosphor layers 26 toward the front substrate 11. The transparent material can be indium tin oxide (ITO). Also, the bus electrodes 31*b* and 32*b* are usually formed of a metal having a high electrical conductivity, and have a double layer structure comprising a black bus electrode layer (not shown) and a white bus electrode layer (not shown). The black bus electrode layer, which is located on a side of the transparent electrodes 31*a* and 32*a*, increases bright room contrast by absorbing external light, and the white bus electrode layer, which is located on a side of the discharge cell, increases brightness by preventing the absorption of visible light emitted from the discharge cells. However, to form the bus electrodes 31*b* and 32*b* made of the black and white bus electrode layers, two processes are required. Therefore, recently, the bus electrodes 31*b* and 32*b* are sometimes formed in one process by forming the black and white bus electrode layers as one unit to simplify the processes.

However, in this case, since the whiteness is reduced, the visible light generated in the discharge cells is absorbed by the one-unit type bus electrodes, and the brightness is reduced.

SUMMARY OF THE INVENTION

The present embodiments provide a plasma display panel that can increase brightness by forming reflectors on surfaces of one-unit type bus electrodes that are disposed facing a surface of the plasma display panel on which images are displayed and face an inner side of discharge cells.

According to an aspect of the present embodiments, there is provided a plasma display panel comprising: a first substrate and a second substrate facing each other; a plurality of barrier ribs that define a space into a plurality of discharge cells between the first and second substrates; a plurality of sustain electrode pairs that extend in a direction between the first and second substrates, and consist of transparent electrodes having light transmittance and bus electrodes formed of a metal, wherein the bus electrodes are made of a dark component that absorbs light and a bright component that reflects light; a plurality of address electrodes crossing the sustain electrode pairs; a first dielectric layer covering the sustain electrode pairs; a second dielectric layer covering the address electrodes; phosphor layers formed in the discharge cells; and first reflectors disposed on surfaces of the bus electrodes facing the centre of the discharge cells to prevent light generated in the discharge cells from being absorbed by the bus electrodes and to reflect the light.

The transparent electrodes, the bus electrodes, and the first reflectors may be sequentially disposed from a surface of the first substrate facing the second substrate toward the second substrate.

The dark component may be Ru, Cu, Mn, or Co, and the bright component may be Ag, Al, Pt, Pd, Ni, or Au.

The first reflectors may be completely buried in the first dielectric layer, or at least a portion of the first reflector may be exposed from the first dielectric layer.

The plasma display panel may further comprise a protective layer that protects the first dielectric layer, and at least a portion of the first reflector may be exposed from the protective layer.

The first reflector may be formed of a material made by adding a white pigment to the same material for forming the first dielectric layer.

The brightness of the PDP may be increased by including first reflectors that prevent light generated in the discharge cells from being absorbed by one-unit type metal electrodes.

The plasma display panel may further comprise second reflectors disposed across the adjacent first reflectors.

The second reflectors may be disposed on the barrier ribs, and may have a thickness equal to the sum of thicknesses of the bus electrode and the first reflector.

The discharge interference between discharge cells can be reduced by forming the second reflectors.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

Figure 1:
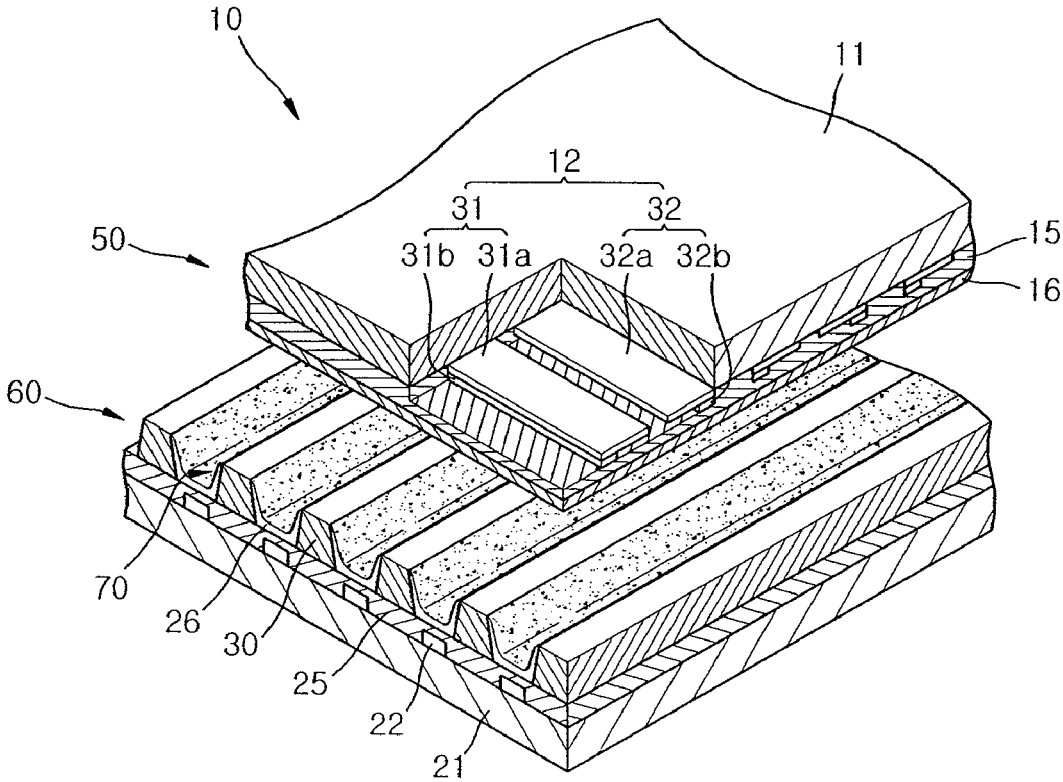
FIG. 1 is an exploded perspective view of a conventional plasma display panel (PDP)
Figure 2:
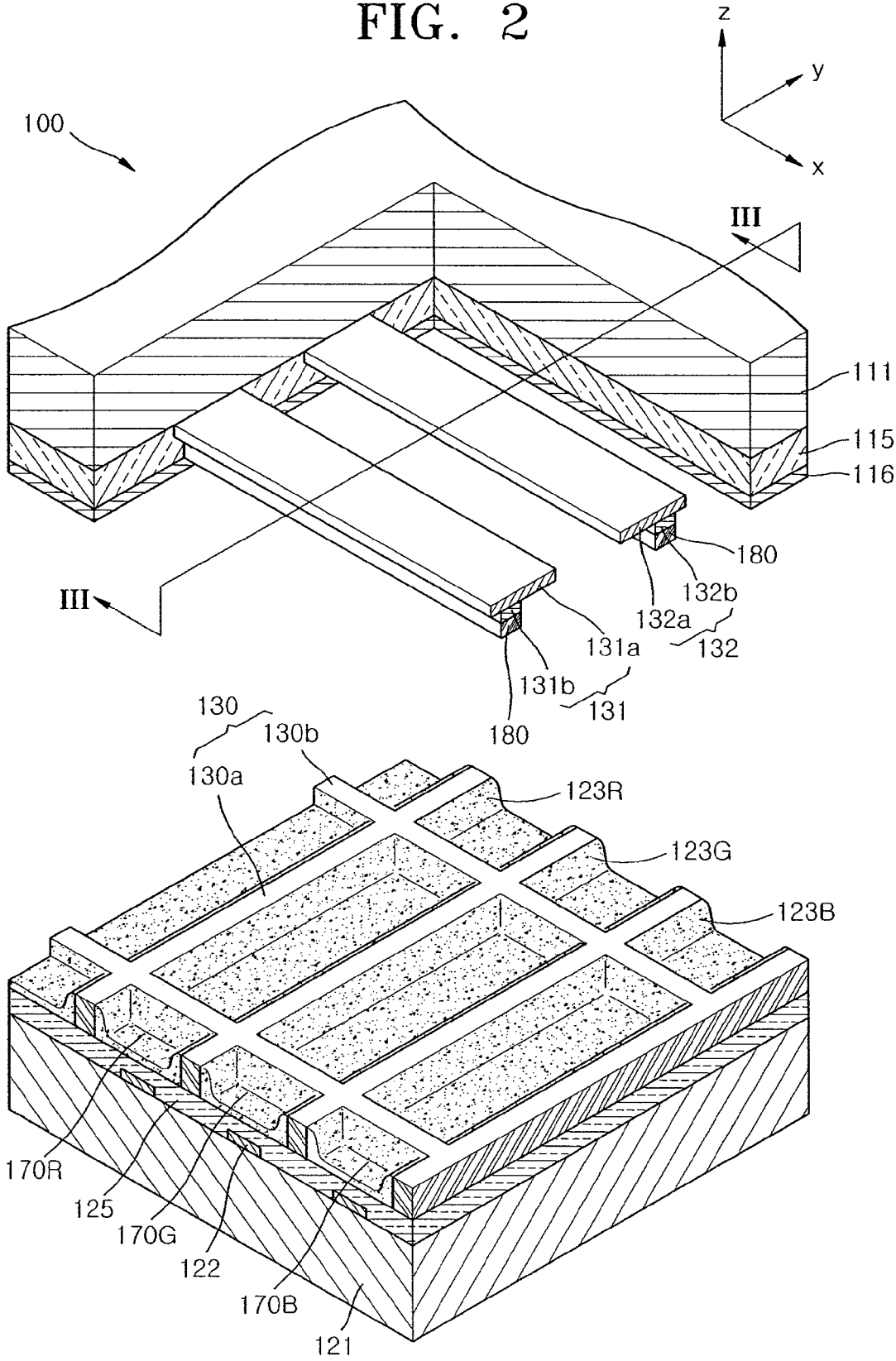
FIG. 2 is a partial cutaway exploded perspective view illustrating a PDP according to an embodiment.
Figure 3:
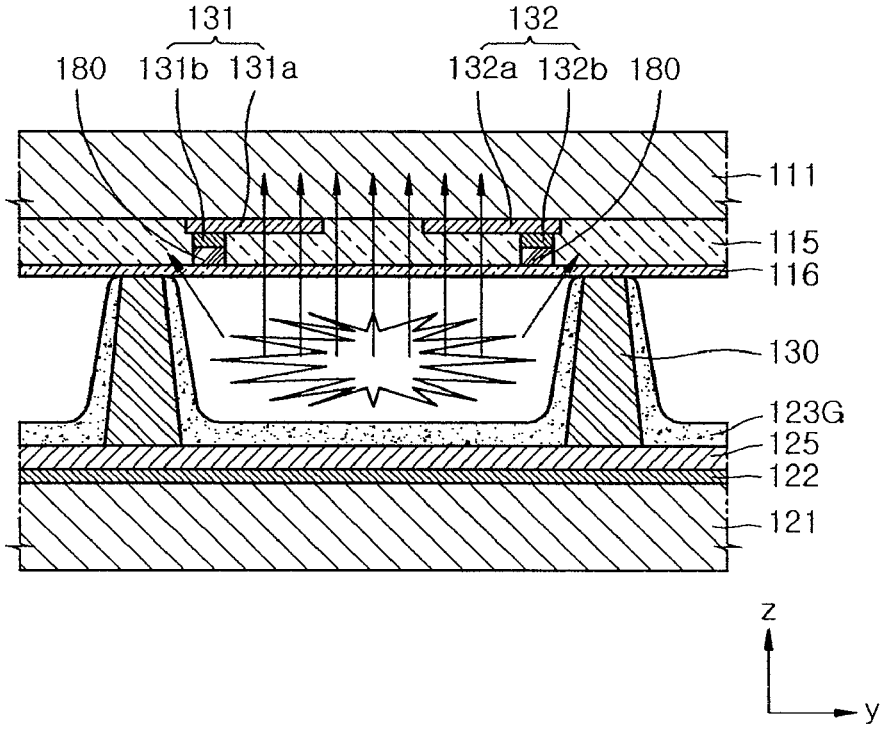
FIG. 3 is a cross-sectional view taken along line III-III of FIG. 2.

The present embodiments will now be described more fully with reference to the accompanying drawings in which exemplary embodiments are shown FIG. 2 is a partial cutaway exploded perspective view illustrating a plasma display panel (PDP) 100 according to an embodiment. FIG. 3 is a cross-sectional view taken along line III-III of FIG. 2, and FIG. 4 is a plan view illustrating a sustain electrode pair and a first reflector disposed on a second substrate in the PDP 100 of FIG. 2.

Figure 4:
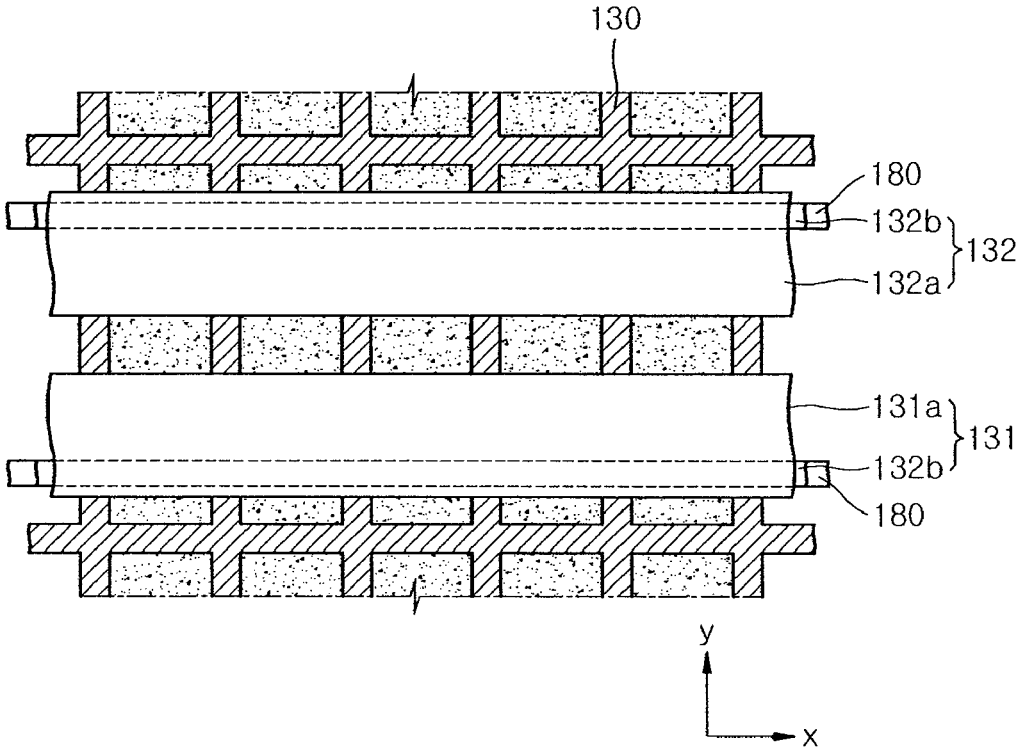
FIG. 4 is a plan view illustrating a sustain electrode pair and a first reflector disposed on a second substrate in the PDP of FIG. 2.

Referring to FIGS. 2 through 4, the alternating current type PDP 100 includes a first substrate 111, a second substrate 121, sustain electrode pairs 131 and 132, address electrodes 122, a plurality of barrier ribs 130 (130*a* and 130*b*), a protective layer 116, phosphor layers 123R, 123G, and 123B, a first dielectric layer 115, a second dielectric layer 125, a discharge gas (not shown), and a first reflector 180.

The first substrate 111 can be a front substrate, and the second substrate 121 can be a rear substrate. The first dielectric layer 115 can be a front dielectric layer, and the second dielectric layer 125 can be a rear dielectric layer.

The front substrate 111 and the rear substrate 121 are disposed a predetermined distance apart, and define a discharge space where discharges are generated. The front substrate 111 and the rear substrate 121 may be formed of a material having a high visible light transmittance such as glass. However, to increase the bright room contrast, the front substrate 111 and/or the rear substrate 121 may be colored.

The barrier ribs 130 are disposed between the front substrate 111 and the rear substrate 121. The barrier ribs 130 may be disposed on the rear dielectric layer 125 depending on the manufacturing process. The barrier ribs 130 define the discharge space into a plurality of discharge cells 170R, 170G, and 170B, and prevent optical and electrical cross-talk between the discharge cells 170R, 170G, and 170B. In FIG. 2, the discharge cells 170R, 170G, and 170B are defined by the barrier ribs 130, which have a matrix arrangement having a rectangular shape horizontal cross-section, but the present embodiments are not limited thereto. That is, the barrier ribs 130 may define the discharge space into discharge cells 170R, 170G, and 170B having a polygon shape horizontal cross section such as a triangle or a pentagon, a circle or an oval shape horizontal cross-section, or an open type cross section such as a stripe. Also, the discharge cells 170R, 170G, and 170B can be defined by the barrier ribs 130 in a waffle or delta shape.

The sustain electrode pairs 131 and 132 are disposed on the front substrate 111 facing the rear substrate 121. Each of the sustain electrode pairs 131 and 132 is a pair of sustain electrodes 131 and 132 formed on a rear surface of the front substrate 111 to cause a sustain discharge, and the sustain electrode pairs 131 and 132 are arranged parallel to each other on the front substrate 111 and separated by a predetermined distance.

Of the pair of sustain electrodes 131 and 132, one sustain electrode is an X electrode 131 that serves as a common electrode, and the other sustain electrode of the pair of sustain electrodes 131 and 132 is a Y electrode 132 that serves as a scan electrode. In the present embodiment, the sustain electrode pairs 131 and 132 are formed on the front substrate 111, but the location of the sustain electrode pairs 131 and 132 is not limited thereto. For example, the sustain electrode pairs 131 and 132 can be disposed a predetermined distance apart from the front substrate 111 in a direction toward the rear substrate 121.

The X electrode 131 and the Y electrode 132 include transparent electrodes 131*a* and 132*a*, respectively, and bus electrodes 131*b* and 132*b*, respectively. The transparent electrodes 131*a* and 132*a* are formed of a transparent and conductive material that can generate a discharge and does not interrupt the progress of light emitted from the phosphor layers 123R, 123G, and 123B through the front substrate 111. For example the transparent electrodes 131*a* and 132*a* may be formed of indium tin oxide (ITO).

However, a transparent and conductive material such as the ITO generally has a high resistance. Accordingly, if the sustain electrodes 131 and 132 are formed using only the transparent electrodes 131*a* and 132*a*, a voltage drop in a length direction is large, resulting in a high driving power consumption and a slow response speed. To solve these drawbacks, the bus electrodes 131*b* and 132*b*, which are formed of a metal with a narrow width, are disposed on the transparent electrodes 131*a* and 132*a*. The bus electrodes 131*b* and 132*b* can be formed in a single layer structure using a metal such as, for example, Ag, Al, or Cu, or can be formed in multiple layers using, for example, Cr/Al/Cr. The transparent electrodes 131*a* and 132*a* and the bus electrodes 131*b* and 132*b* can be formed using a photo etching method, a photolithography method, etc.

The shapes and locations of the X electrode 131 and the Y electrode 132 will now be described. The bus electrodes 131*b* and 132*b* are disposed parallel to each other and separated by a predetermined distance in the unit discharge cells 170R, 170G, and 170B, and extend across the discharge cells 170R, 170G, and 170B. As described above, the transparent electrodes 131*a* and 132*a* are respectively electrically connected to the bus electrodes 131*b* and 132*b*, and the rectangular shape transparent electrodes 131*a* and 132*a* can be discontinuously disposed in each of the unit discharge cells 170R, 170G, and 170B. One edge of each of the transparent electrodes 131*a* and 132*a* is connected to the bus electrodes 131*b* and 132*b*, and the other edge of each of the transparent electrodes 131*a* and 132*a* is disposed to face a central portion of each of the discharge cells 170R, 170G, and 170B.

The front dielectric layer 115 covering the sustain electrode pairs 131 and 132 is formed on the front substrate 111. The front dielectric layer 115 prevents cross-talk between adjacent X electrodes 131 and Y electrodes 132, and also prevents the X electrodes 131 and the Y electrodes 132 from being damaged due to direct collisions of charged particles or electrons with the X electrodes 131 and the Y electrodes 132. Also, the front dielectric layer 115 can function to induce charges. The front dielectric layer 115 can be formed of, for example, PbO, $B_2O_3$, $SiO_2$, etc.

Also, the PDP 100 may further include the protective layer 116 covering the front dielectric layer 115. The protective layer 116 also protects the front dielectric layer 115 from being damaged due to collisions of charged particles or electrons with the front dielectric layer 115 during discharging.

The protective layer 116 facilitates the occurrence of plasma discharge by emitting secondary electrons during discharges. The protective layer 116 is formed of a material having a high secondary electron emission coefficient and high visible light transmittance. The protective layer 116 can be formed in a thin film mainly using a sputtering method or an electron beam evaporation method after the front dielectric layer 115 is formed.

The address electrodes 122 are disposed on the rear substrate 121 facing the front substrate 111. The address electrodes 122 extend across the X electrode 131 and the Y electrode 132, which cross the discharge cells 170R, 170G, and 170B.

The address electrodes 122 are formed to generate address discharges that facilitate the generation of sustain discharges between the X electrode 131 and the Y electrode 132. More specifically, the address electrodes 122 reduce the voltage needed to generate the stain discharge. Address discharges are generated between the Y electrodes 132 and the address electrodes 122. When an address discharge is completed, wall charges are accumulated on the X electrodes 131 and the Y electrodes 132, which facilitate the generation of stain discharges between the X electrodes 131 and the Y electrodes 132.

Spaces formed by the pairs of the X electrodes 131 and the Y electrodes 132 and the address electrodes 122 that cross the X and Y electrodes 131 and 132 are unit discharge cells 170R, 170G, and 170B.

The rear dielectric layer 125 covering the address electrodes 122 is formed on the rear substrate 121. The rear dielectric layer 125 is formed of a dielectric that can prevent the address electrodes 122 from being damaged due to collisions of charged particles or electrons with the address electrodes 122 during a discharge, and can induce charges. For example, the rear dielectric layer 125 may be formed of, for example, PbO, $B_2O_3$, $SiO_2$, etc.

Red, green, and blue phosphor layers 123R, 123G, and 123B are disposed on both side surfaces of the barrier ribs 130 formed on the rear dielectric layer 125 and on an entire surface of the rear dielectric layer 125 where the barrier ribs 130 are not formed. The phosphor layers 123R, 123G, and 123B include a component that emits visible light when the component is excited by ultraviolet rays. The phosphor layer 123R formed in the red light emitting discharge cell includes a phosphor material such as $Y(V,P)O_4$:Eu, the phosphor layer 123G formed in the green light emitting discharge cell includes a phosphor material such as $Zn_2SiO_4$:Mn, $YBO_3$:Tb, and the like, and the phosphor layer 123B formed in the blue light emitting discharge cell includes a phosphor material such as BAM:Eu.

A discharge gas such as a mixture of Ne gas and Xe gas, and the like is filled into the discharge cells 170R, 170G, and 170B. When the filling of the discharge gas is finished the front substrate 111 and the rear substrate 121 are coupled to each other using a sealing member such as frit glass formed on edges of the front and rear substrates 111 and 121.

After the discharge gas is excited during a sustain discharge, ultraviolet rays are emitted from the discharge gas as an energy level of the discharge gas is reduced. The ultraviolet rays excite the phosphor layers 123R, 123G, and 123B coated in the discharge cells 170R, 170G, and 170B, and visible light is emitted from the phosphor layers 123R, 123G, and 123B as the energy level of the phosphor layers 123R, 123G, and 123B is reduced. The visible light forms images on the PDP 100 by transmitting through the front dielectric layer 115 and the front substrate 111.

The bus electrodes 131*b* and 132*b* are formed by mixing a dark component that absorbs light with a bright component that reflects light. The dark component can be, for example Ru, Cu, Mn, Co or alloys thereof or combinations thereof, and the bright component can be example, Ag, Al, Pt, Pd, Ni, Au or alloys thereof or combinations thereof.

In this way, since the bus electrodes 131*b* and 132*b* are formed in one unit by mixing the dark component that absorbs light and the bright component that reflects light, manufacturing processes can be simplified compared to the case of separate type bus electrodes. That is, to manufacture separate type bus electrodes, a black bus electrode layer and a white bus electrode layer must be formed in separated processes, but in the case of the one-unit type bus electrodes, the black bus electrode layer and the white bus electrode layer can be formed in one process.

The first reflector 180 is disposed in the first dielectric layer 115 and on a surface of the bus electrodes 131*b* and 132*b* facing an inner part of a discharge cell. More specifically, the first reflector 180 can be extended to a surface of the first dielectric layer 115 facing the second substrate 121, that is, to a lower surface of the first dielectric layer 115. Also, depicted in FIG. 5 a first reflector 181 can be extended to a lower surface of the protective layer 116. In this embodiment, at least a portion of the first reflector is exposed from the protective layer. Accordingly, in some embodiments, the transparent electrodes 131*a* and 132*a*, the bus electrodes 131*b* and 132*b*, and the first reflector 180 are sequentially disposed from the first substrate 111 toward the second substrate 121. The first reflectors 180 are disposed on the surfaces of the bus electrodes 131*b* and 132*b* to prevent light generated in the discharge cell from being absorbed by the bus electrodes 131*b* and 132*b* and to reflect the light.

For this purpose, the first reflector 180 may be formed of a material that readily reflects light. That is, the first reflector 180 can be a white layer so that light incident on the first reflector 180 can be readily reflected. In one embodiment, the first reflector 180 may be formed of a material made by adding a white pigment to the same material for forming the first dielectric layer 115.

Also, as another embodiment, the bus electrodes 131*b* and 132*b* can be black layers so that the bus electrodes 131*b* and 132*b* can further contribute to an increase in the contrast by efficiently absorbing light entering from the outside.

Figure 6:
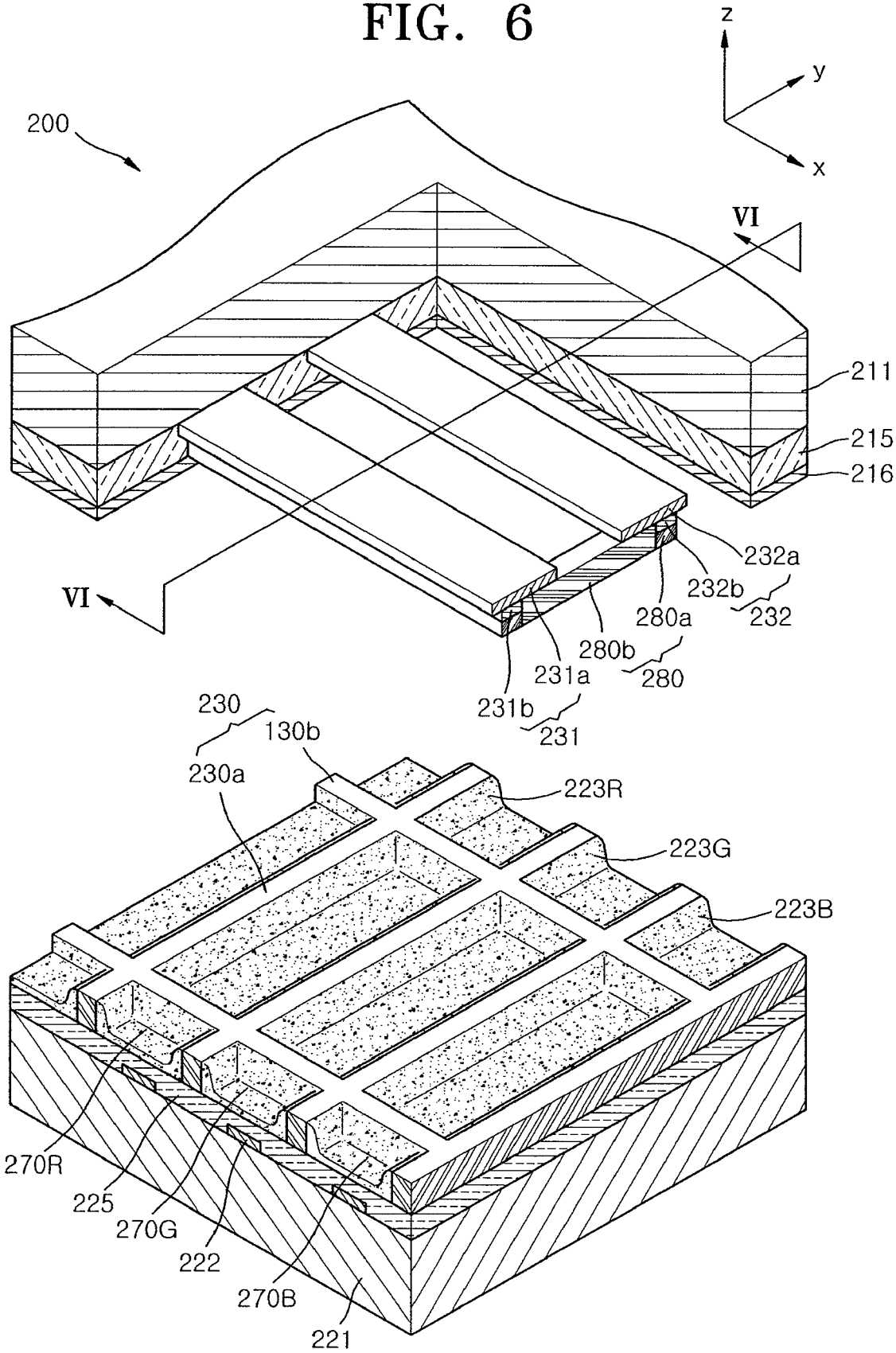
FIG. 6 is a partial cutaway exploded perspective view illustrating a PDP according to another embodiment.
Figure 7:
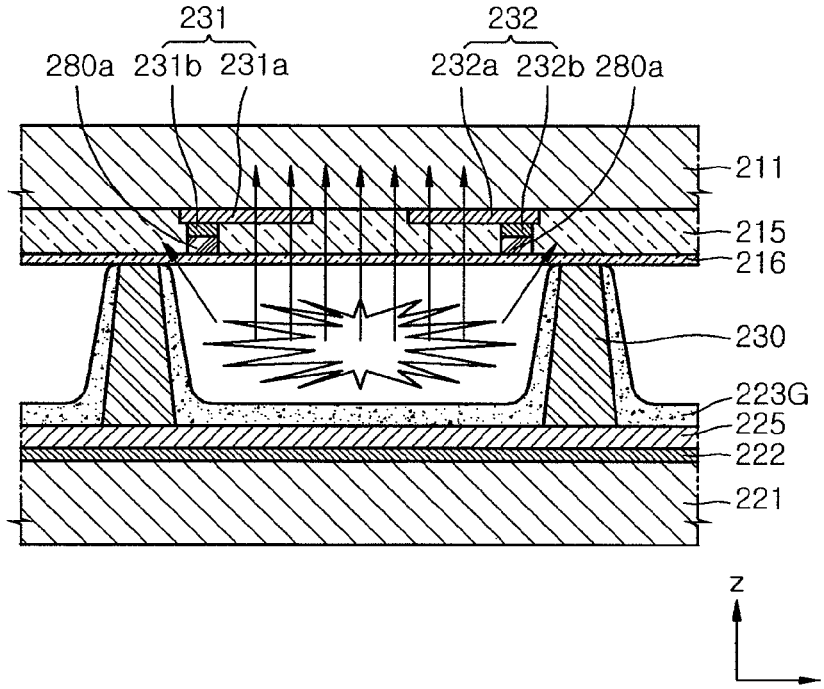
FIG. 7 is a cross-sectional view taken along line VI-VI of FIG. 6.

FIG. 6 is a partial cutaway exploded perspective view illustrating a PDP 200 according to another embodiment. FIG. 7 is a cross-sectional view taken along line VI-VI of FIG. 6 and FIG. 8 is a plan view illustrating a sustain electrode pair, a first reflector 280*a*, and a second reflector 280*b* disposed on a second substrate in the PDP 200 of FIG. 6.

Figure 8:
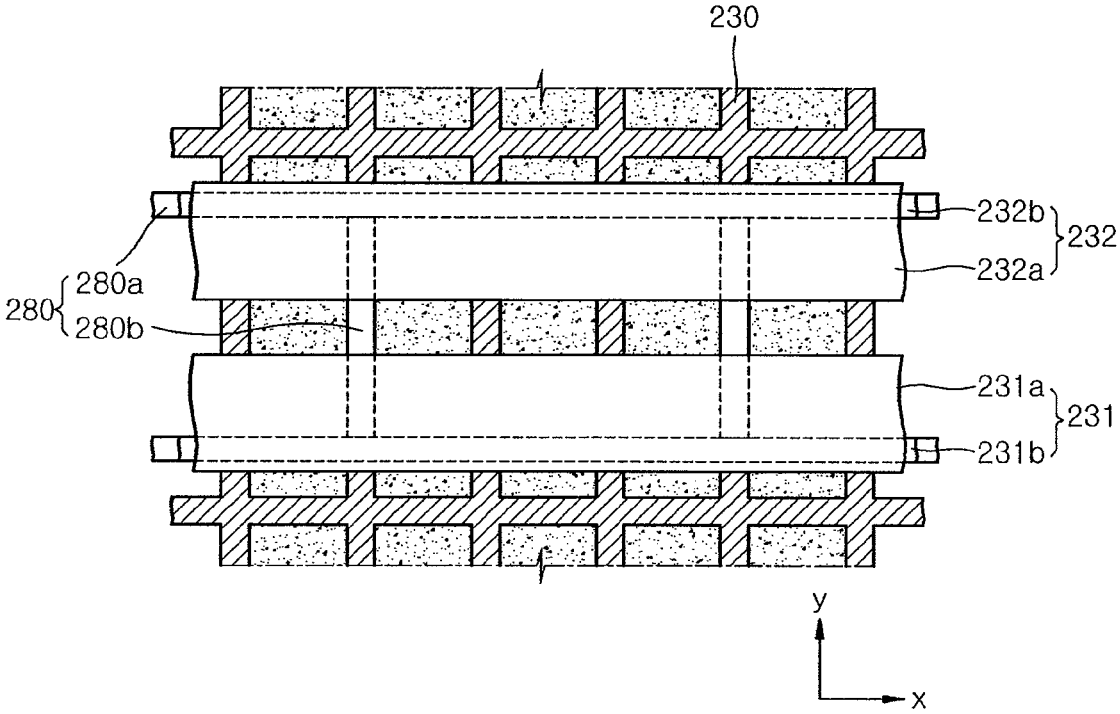
FIG. 8 is a plan view illustrating a sustain electrode pair, a first reflector, and a second reflector disposed on a second substrate in the PDP of FIG. 6

Referring to FIGS. 6 through 8, the alternating current type PDP 200 includes a first substrate 211, a second substrate 221, sustain electrode pairs 231 and 232, address electrodes 222, barrier ribs 230, a protective layer 216, phosphor layers 223R, 223G, and 223B, a first dielectric layer 215, a second dielectric layer 225, a discharge gas (not shown), and a reflector 280.

The first substrate 211 is a front substrate and the second substrate 221 is a rear substrate. The first dielectric layer 215 is a front dielectric layer, and the second dielectric layer 225 is a rear dielectric layer. Also, the sustain electrode pairs 231 and 232 can include an X electrode 231 and a Y electrode 232, respectively, and the X electrode 231 and the Y electrode 232 can include transparent electrodes 231*a* and 232*a*, respectively, and bus electrodes 231*b* and 232*b*, respectively.

In the PDP 100 depicted in FIGS. 2 through 4, the reflectors 180 are formed along the bus electrodes 131*b* and 132*b*. However, in the present embodiment, the second reflectors 280*b*, which cross the X and Y electrodes 231 and 232, are further included on the barrier ribs 130 that define pixels in the PDP 100 of FIGS. 2 through 4.

Figure 5:
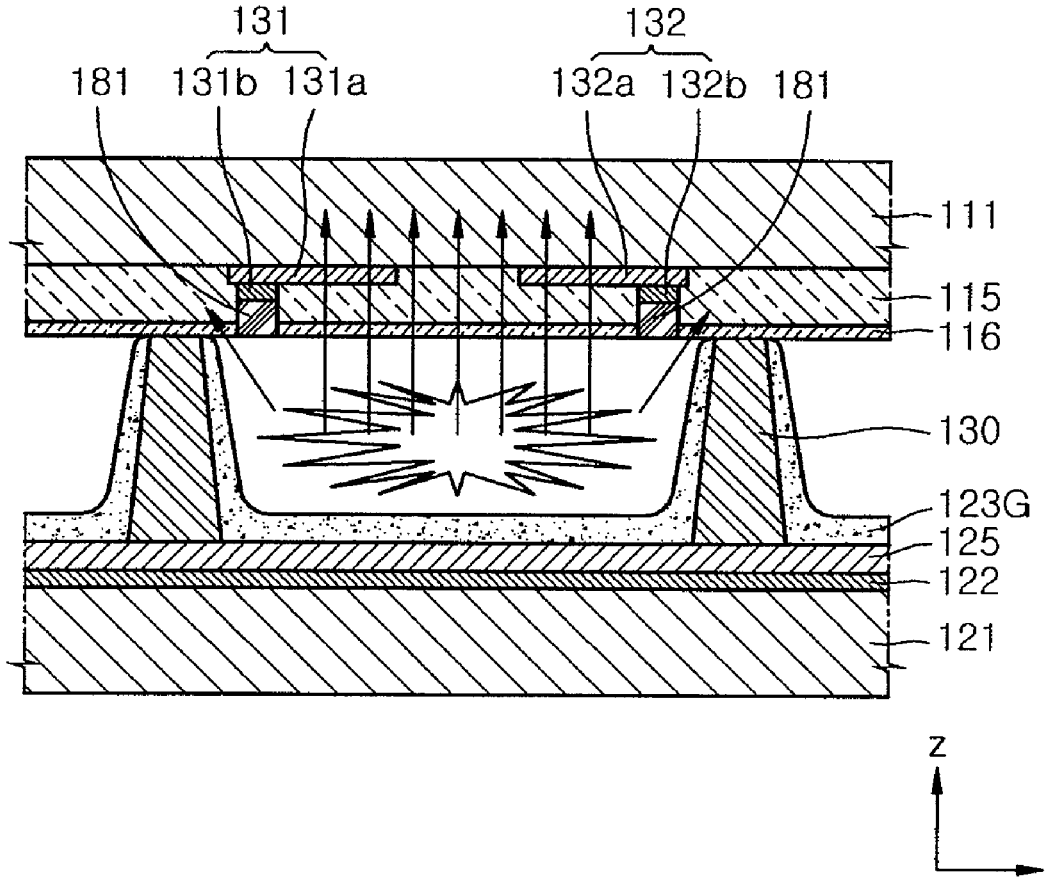
FIG. 5 is a cross-sectional view taken alone line III-III of FIG. 2.

The second reflectors 280*b* are disposed on the barrier ribs 230 across the adjacent first reflectors 280*a*. Also, as depicted in FIG. 5, the second reflector 280*b* can be formed to a thickness equal to the sum of thicknesses of the bus electrode and the first reflector to reduce discharge interference between adjacent discharge cells.

The second reflectors 280*b* are disposed on the barrier ribs 230 across the adjacent first reflectors 280*a*. Also, as depicted in FIG. 6 the second reflector 280*b* can be formed to a thickness equal to the sum of thicknesses of the bus electrode and the first reflector to reduce discharge interference between adjacent discharge cells.

Also, as depicted in FIG. 6 the second reflector 280*b* can be disposed on each pixel unit. That is, the second reflectors 280*b* can be disposed on the barrier ribs 230*a* that separate each of the pixels. However, the present embodiments are not limited thereto, and the second reflectors 280*b* can be disposed on barrier ribs that separate each of the discharge cells.

In the present embodiment depicted in FIGS. 6 through 8 the second reflectors 280*b* are included in addition to the elements in the previous embodiment depicted in FIGS. 2 through 4. Similar reference numerals in FIGS. 6 through 8 are used for like elements performing the same functions as those in FIGS. 2 through 4, and thus, detailed descriptions thereof will not be repeated.

However, as depicted in FIGS. 6 through 8, in the PDP 200 according to the present embodiment, the light emission interference between adjacent discharge cells can be further prevented by disposing the second reflectors 280*b* in each pixel unit.

A PDP according to the present embodiments can increase brightness by using a reflector to reflect light generated in discharge cells. The reflector can be formed on a surface of a metal electrode that is disposed facing a surface of the panel where images are displayed, and the reflector faces the center of the discharge cells.

Also, the PDP can increase contrast using a metal electrode that absorbs light entering from the outside.

Also, the PDP can increase clearness of images displayed on a panel by removing discharge interference between adjacent discharge cells.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A plasma display panel comprising:

a first substrate and a second substrate facing each other;

a plurality of barrier ribs that define a plurality of discharge cells between the first and second substrates;

a plurality of sustain electrode pairs that extend in a direction between the plurality of barrier ribs and the first substrate, and comprise transparent electrodes and bus electrodes formed of a metal, wherein the bus electrodes are made of a dark component that absorbs light and a bright component that reflects light;

a plurality of address electrodes crossing the sustain electrode pairs;

a first dielectric layer covering the sustain electrode pairs;

a second dielectric layer covering the address electrodes;

phosphor layers formed in the discharge cells;

first reflectors disposed on at least one surface of the bus electrodes, wherein the at least one surface faces the discharge cells, and wherein the first reflectors are configured to prevent light generated in the discharge cells from being absorbed by the bus electrodes and to reflect the light; and second reflectors between the barrier ribs and the first substrate, and substantially perpendicular to the first reflectors, wherein at least a portion of the first reflector is exposed from the first dielectric layer.

2. The plasma display panel of claim 1, wherein the transparent electrodes, the bus electrodes, and the first reflectors are sequentially disposed from a surface of the first substrate facing the second substrate toward the second substrate.

3. The plasma display panel of claim 1, wherein the dark component is selected from the group consisting of Ru, Cu, Mn, Co, alloys thereof and combinations thereof, and the bright component is selected from the group consisting of Ag, Al, Pt, Pd, Ni, Au, alloys thereof and combinations thereof.

4. The plasma display panel of claim 1, wherein the first reflector is formed of a material made by adding a white pigment to the same material used for forming the first dielectric layer.

5. The plasma display panel of claim 1, wherein the second reflectors are disposed to correspond to the barrier ribs.

6. The plasma display panel of claim 1, wherein the second reflectors are disposed corresponding to each pixel unit.

7. The plasma display panel of claim 1, wherein the second reflector is formed of a material made by adding a white pigment to the same material used for forming the first dielectric layer.

8. A plasma display panel comprising:

a first substrate and a second substrate facing each other;

a plurality of barrier ribs that define a plurality of discharge cells between the first and second substrates;

a plurality of sustain electrode pairs that extend in a direction between the plurality of barrier ribs and the first substrate, and comprise transparent electrodes and bus electrodes formed of a metal, wherein the bus electrodes are made of a dark component that absorbs light and a bright component that reflects light;

a plurality of address electrodes crossing the sustain electrode pairs;

a first dielectric layer covering the sustain electrode pairs;

a second dielectric layer covering the address electrodes;

phosphor layers formed in the discharge cells;

first reflectors disposed on at least one surface of the bus electrodes, wherein the at least one surface faces the discharge cells, and wherein the first reflectors are configured to prevent light generated in the discharge cells from being absorbed by the bus electrodes and to reflect the light; and second reflectors between the barrier ribs and the first substrate, and substantially perpendicular to the first reflectors, further comprising a protective layer that protects the first dielectric layer, wherein at least a portion of the first reflector is exposed from the protective layer.

9. A plasma display panel comprising:

a first substrate and a second substrate facing each other;

a plurality of barrier ribs that define a plurality of discharge cells between the first and second substrates;

a plurality of sustain electrode pairs that extend in a direction between the plurality of barrier ribs and the first substrate, and comprise transparent electrodes and bus electrodes formed of a metal, wherein the bus electrodes are made of a dark component that absorbs light and a bright component that reflects light;

a plurality of address electrodes crossing the sustain electrode pairs;

a first dielectric layer covering the sustain electrode pairs;

a second dielectric layer covering the address electrodes;

phosphor layers formed in the discharge cells;

first reflectors disposed on at least one surface of the bus electrodes, wherein the at least one surface faces the discharge cells, and wherein the first reflectors are configured to prevent light generated in the discharge cells from being absorbed by the bus electrodes and to reflect the light; and second reflectors between the barrier ribs and the first substrate, and substantially perpendicular to the first reflectors, wherein the second reflector has a thickness equal to the sum of thicknesses of the bus electrode and the thickness of the first reflector.

* * * * *